United States Patent [19]

Seeger et al.

[11] Patent Number: 4,519,291

[45] Date of Patent: May 28, 1985

[54] LOCKING DEVICE FOR AIR-TO-AIR GUIDED MISSILES

[75] Inventors: G. Hans J. Seeger, Überlingen; Peter Giesenberg, Salem; Johannes Steimel, Constance, all of Fed. Rep. of Germany

[73] Assignee: Bodenseewerk Geratetechnik GmbH, Uberlingen, Fed. Rep. of Germany

[21] Appl. No.: 549,878

[22] Filed: Nov. 9, 1983

[30] Foreign Application Priority Data

Jan. 19, 1983 [DE] Fed. Rep. of Germany ..... 3301567

[51] Int. Cl.[3] ..... F41F 3/04

[52] U.S. Cl. ..... 89/1.806; 89/1.812; 244/137 R

[58] Field of Search ..... 89/1.806, 1.812, 1.8, 89/1.816, 1.819, 1.50; 244/137 R

[56] References Cited

U.S. PATENT DOCUMENTS

| | | | |
|---|---|---|---|
| 2,867,153 | 1/1959 | Hirsch | 89/1.806 |
| 3,602,091 | 8/1971 | Fryklund et al. | 89/1.806 |
| 3,659,493 | 5/1972 | Wissner | 89/1.807 |
| 3,892,266 | 7/1975 | Murray | 89/1.801 |
| 3,983,785 | 10/1976 | Dissmeyer et al. | 89/1.806 X |
| 4,016,796 | 4/1977 | Brannan | 89/1.806 |
| 4,132,150 | 1/1979 | Conn | 89/1.806 |
| 4,336,740 | 6/1982 | Leigh et al. | 89/1.806 |
| 4,358,983 | 11/1983 | Fallon et al. | 89/1.806 |

FOREIGN PATENT DOCUMENTS

| | | |
|---|---|---|
| 924074 | 4/1963 | United Kingdom . |
| 1160529 | 8/1969 | United Kingdom . |
| 1182275 | 2/1970 | United Kingdom . |

*Primary Examiner*—David H. Brown

*Attorney, Agent, or Firm*—Lee, Smith & Zickert

[57] ABSTRACT

An air-to-air guided missile with solid propellant rocket motor is retained by a locking device having a blocking device during a predeterminable delay time after the rocket motor has been fired. Thereby, at high altitude or with a high speed, such a proportion of the propellant can be burnt off that the guided missile is not accelerated to an inadmissibly high speed.

11 Claims, 2 Drawing Figures

LOCKING DEVICE FOR AIR-TO-AIR GUIDED MISSILES

The invention relates to a locking device for air-to-air guided missiles with solid propellant rocket motors.

Locking devices are components of launchers. They are to prevent a missile from starting without sufficient thrust build-up and from sliding out of the starting device. The missile could slide out for example when an aircraft carrying the missile is strongly braked by a catching device when landing on an aircraft carrier.

A prior art locking device of this type comprises a blocking catch pivotable about a pivot point, which blocking catch extends with a lug over a guiding shoe attached to the guided missile. A bias means in the form of an adjustable spring acts on the blocking catch. This bias means tends to hold the blocking catch with the stop means in operative position in the path of the guiding shoe against the thrust of the rocket motor of the guided missile such that the guided missile is retained in the starting device. When the rocket motor is fired during normal launching, the launch thrust is built up quickly. The torque exerted on the blocking catch by the launch thrust through the stop means exceeds the opposite torque which is exerted on the blocking catch about the pivot point by the bias means. The stop means is pushed aside by the thrust of the rocket motor while the blocking catch is pivoted and the guided missile is air-launched.

Furthermore additional locking means are known in the prior art, which, depending on mechanical switches, cause the guided missile to be rigidly fixed in its position such that the guided missile is retained in the launcher even when the rocket motor burns off normally. These locking means are opened only after the aircraft has taken off from the ground. This ensures that the guided missile cannot be fired before the aircraft has taken off. Thus these prior art locking devices, when loaded by a thrust, open either immediately, as soon as a predetermined thrust is obtained, or not at all.

In guided missiles for air-to-air mission it is a problem to correctly proportion the drive energy installed in the rocket motor. The guided missile is to have a sufficient range at low altitudes with relatively low speeds of the aircrafts. This requires a relatively high drive energy of the rocket motor. If, however, such a guided missile is fired at high altitudes and with high speeds of the aircraft, then the drive energy installed in the rocket motor accelerates the guided missile to very high maximum speeds. The maximum speed obtained by the guided missile can be a multiple of the sonic speed. These high speeds of the guided missile can involve undesirable effects. The structure can for example be heated up aerodynamically. In guided missiles having an infrared seeker head, the ability to be automatically guided into the target is then impeded or eliminated.

It is the object of the invention to avoid such excess speeds of the guided missile by simple means.

According to the invention this object is achieved by a blocking device, which is adapted to delay the release of the guided missile by a predeterminable delay time relative to the firing of the rocket motor.

With a conventional solid propellant rocket motor having one propellant charge only, an excess maximum speed of the guided missile is avoided according to the invention in that, if required, the missile at first remains retained at the aircraft after the rocket motor has been fired. The air-launching of the guided missile is not released until part of the installed drive energy has burnt off. In this case the linear momentum of the rocket motor acts on the total system of aircraft plus missile. Due to the big mass of the aircraft and to the big moments of inertia, the reactions of the aircraft are small. The case that a rocket motor completely burns off due to the missile being jammed at the aircraft (hangfire) occurs occasionally also with prior art launchers and is mastered by the pilot. Thereby the aircraft does not suffer damage. Therefore it is also feasible to burn off part of the installed drive energy of the solid propellant rocket motor at the aircraft.

Modifications of the invention are subject matter of the sub-claims.

An embodiment of the invention will now be described in greater detail with reference to the accompanying drawings.

Figure 1:
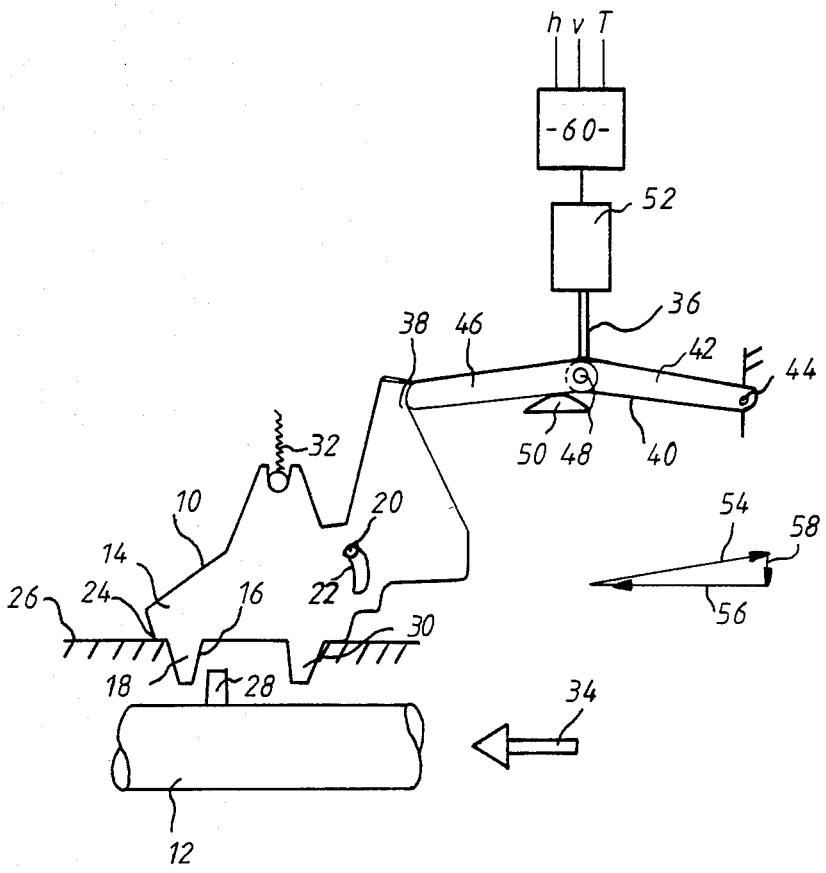
FIG. 1 is a schematic illustration of a locking device for guided missiles.

The locking device 10 for a guided missile 12 comprises a blocking catch 14 having a lug 18 forming a stop means 16. The blocking catch 14 is pivotable about a pivot axis 20. The pivot axis 20 is determined by a bearing pin which is guided in an arcuated, elongated hole 22 of the blocking catch 14. The blocking catch 14 is supported with an edge 24 on the edge 26 of an aperture provided in the launcher. The lug 18 extends into the aperture. The stop means 16 extends over a guiding shoe 28 provided on the guided missile 12. The guided missile 12 is movably guided in the launcher horizontally in the figure. The lug 18 with the stop means 16 extends on one side into the path of the projection 28 and thus prevents the guided missile 12 from moving toward the left in the figure. A second lug at the blocking catch 14, which lug extends into the aperture on the other side of the projection 28, limits the movement of the guided missile 12 toward the right in the figure. A bias means 32 in the form of a biassed spring acts on the blocking catch 14. This spring exerts a torque on the blocking catch 14 counter-clockwise about the pivot axis 20, which torque keeps the edge 24 in engagement with the edge 26 such that the blocking catch 14 with the stop means 16 is in operative position.

After the rocket motor of the guided missile 12 has been fired, a motor thrust directed toward the left in the figure is built up, which thrust is indicated in the figure by the arrow 34. This motor thrust acts on the stop means 16 through the projection 28 and tends to push away the stop means 16 and thereby to pivot the blocking catch 14 clockwise against the action of the spring 32. Leaving the blocking device 36 still to be described out of account, this takes place as soon as a sufficiently large motor thrust has built up which thrust ensures the guided missile to be air-launched correctly.

That is essentially the prior art construction of a locking device releasable by the motor thrust.

In the illustrated preferred embodiment the blocking device 36 is provided, which cooperates with a locking surface 38 of the blocking catch 14 in a block position illustrated in the figure such that the blocking catch 14 is prevented from pivoting under the action the motor thrust 34 acting or the stop means 16, until the blocking device 36 moves into a release position.

The blocking device 36 comprises a toggle lever mechanism 40 having a first link 42 which, at one end, is pivoted structure-fixed in a bearing 44, and a second link 46 which, with one end is pivoted at the other end of the first link through a joint 48 and, with its other end to the left in the figure, is supported on the locking surface 38. Therein the locking surface 38 is slightly concave for preventing the link 46 from gliding off. The links 42 and 46 get into engagement with the stop means so such that a very obtuse angle of mearly 180° is formed. The stop means 50 is located in this angle. A displacement member 52 engages the joint 48 between the two links, and is arranged to keep the joint 48 in engagement with the stop means 50 in one operating state and, in another operating state, to move joint in the sense to reduce the angle between the links 42 and 46. The stop means 50 is mounted structure-fixed. The displacement member 52 is a solenoid, by which the joint 48 is caused to engage the stop means or to be lifted from the stop means 50. The solenoid 52 is arranged on the side of the toggle lever mechanism 4o remote from the stop means 50. The solenoid 52, when energized, is in an operative position in which it keeps the toggle lever mechanism in its block position. When the solenoid is deenergized, it is movable into its release position by a restoring force, for example a spring.

In the block position the joint 48 and the toggle lever mechanism 40 are urged against the stop means 50. Thereby the links 42 and 46 form an angle of nearly 180°. Therefore solenoid 52 only has to exert a very small force for keeping the links 42,46 in this position, also when a rather large force is exerted on the link 46 through the locking surface 38 by the motor thrust which tends to pivot the blocking catch 14 clockwise. This can be seen from the triangle of forces added to the figure: The vector 54 designates the force which is acting in the longitudinal direction of the link 46. The horizontal component thereof (seen in the figure) is taken up by the link 42 and the bearing 44. This is illustrated by the vector 56. The solenoid 52 has to exert only the relatively small force illustrated by the vector 58. When the solenoid 52 is deenergized, the restoring force pulls the joint 48 upward in the figure such that the angle between the links 42 and 46 is reduced. Thereby the locking surface 38 can move toward the right in the figure. The blocking catch 14 can pivot clockwise under the action of the motor thrust 34. The stop means 16 moves out of the path of the projection 28 upward toward the left and the guided missile 12 is released.

The release of the guided missile 12 can be delayed by a predetermined delay time relative to the firing of the rocket motor by means of a blocking device 36. This delay time can be input by the pilot. A computer 60 is provided in the illustrated preferred embodiment, to which computer 60 state variables, for example the flight altitude h, the flying speed v and the temperature T are applied, which state variables determine the maximum speed imported to the guided missile by the rocket motor. The computer 60 determines a delay time from these state variables, during which delay time such a proportion of the propellant burns off that the maximum speed imparted to the guided missile 12 by the rocket motor with the remaining propellant is limited to a predetermined, admissible value. The locking device 10 is controlled by the computer 60 such that, after the motor has been fired, the guided missile 12 is released with a delay time determined by the computer.

The described locking device is simple in construction. It solves the above described problem. The construction is such that existing, conventional locking devices may easily be converted by the installation of the locking device 36.

Figure 2:
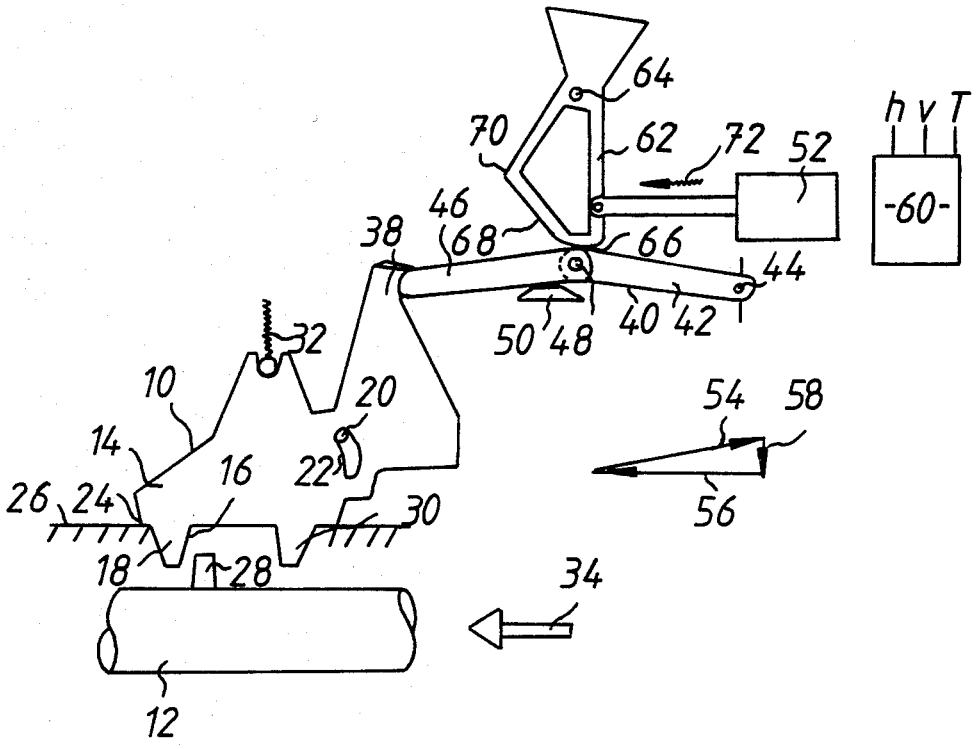
FIG. 2 shows in a similar illustration a modified embodiment.

FIG. 2 shows a modified embodiment, in which the displacement member 52 makes an essentially horizontal displacement movement. The basic structure in the embodiment of FIG. 2 is similar to FIG. 1 and corresponding parts in FIG. 2 are designated by the same reference numerals as in FIG. 1.

The displacement member 52 engages the joint 48 through a pivotable intermediate member 62 which is pivotable by the displacement member 52 between a first position illustrated in FIG. 2, in which position it keeps the joint 48 in engagement with the stop means 50, and a second position, in which it releases the joint 48. The intermediate member 62 is pivotable about a pivot axis 64. In the operational state illustrated in FIG. 2, in which state the joint 48 engages the stop means 50 the pivot axis 64 of the intermediate member 62 extends essentially through the angle bisector of the obtuse angle between the two links 42,46. The intermediate member 62 is a cam of generally triangular shape. The cam has a rounded contour 66 at one edge of the triangle to which contour 66 an inclined surface 68 is connected, which leads to an edge 70 which has a smaller distance from the pivot axis 64 than the rounded contour 66. The intermediate member 62 is kept in its first position by a biased spring 72 and pivoted counterclockwise against the action of this spring by the displacement member 52. In this way, the displacement member can normally, that is during the carrying flight, be deenergized.

In the arrangement described, a self-locking is obtained in the first operational state illustrated. The intermediate member 62 engages the joint 48 with the rounded contour. The line of action of a resultant force cranking the joint 48 extends through the pivot axis 64 of the intermediate member 62. Thus this force does not exert any torque on the intermediate member 62. By this self-locking locking greater safety of operation of the locking device is obtained with longitudinal and transverse accelerations during the carrying flight.

The locking device is released by the computer 60, by which the supply voltage for the displacement member 52 is switched on. Thereafter displacement member 52 pulls the intermediate member 62 toward the right in FIG. 2. Thereby the toggle lever mechanism 40 with the two links 42,46 can be deflected by the blocking catch 14 with small force. Thereby the missile 12 is released.

After the missile 12 has been fired the intermediate member 62 is urged again toward the left in FIG. 2 by the biased spring 72. The toggle lever mechanism 40 is moved into the operational position illustrated (block position) by the inclined surface 68 of the intermediate member 62.

We claim:

1. Locking device for air-to-air guided missiles having a solid propellant rocket motor and having means to delay release of the guided missile, characterized by (a) means for setting a delay time for release of the guided missile relative to the firing of the rocket motor, said delay time being independent of the thrust of the rocket, and (b) a blocing device controlled by said setting means to release the guided missile after said delay time.

2. Locking device as set forth in claim 1, characterized in that (a) a computer (60) is provided, to which state variables are applied, which determine the maximum speed imparted to the guided missile (12) by the rocket motor, (b) the computer (60) determines said delay time from said state variables, during which delay time such a proportion of the propellant burns off that the maximum speed imparted to the guided missile (12) by the rocket motor with the remaining propellant is limited to a predetermined, admissible value, and (c) said locking device (10) is operatively connected to releasing means (52), said releasing means (52) being energized by a release signal, said computer comprising means for applying said release signal to said releasing means after said delay time.

3. Locking device as set forth in claim 1 or 2, characterized by (a) a blocking catch (14) pivotable about a pivot axis (20), which blocking catch (14) extends with a stop means (16) over a guiding shoe (28) on the guided missile (12), (b) a bias means (32) acting on the blocking catch (14) for keeping the blocking catch (14) with the stop means (16) in operative position, and (c) a locking surface (38) at the blocking catch (14), which cooperates with the blocking device (36) in a blocking position of it such that the blocking catch (14) is prevented from pivoting under the action of the motor thrust (34) acting on the stop means (16), until the blocking device (36) moves into a release position.

4. Locking device as set forth in claim 3, characterized in that the blocking device (36) comprises (a) a toggle lever mechanism (40) having ($a_1$) a first link (42) which at one end, is pivoted structure-fixed, and ($a_2$) a second link (46) which, with one end, is pivoted at the other end of the first link (42) and which, with its other end, is supported on the locking surface (38), (b) a stop means (50), with which the links (42, 46), get into engagement such that they form a very obtuse angle, in which the stop means (50) is located, and (c) a displacement member (52) engaging the joint (48) between the two links (42,46), and arranged to keep (52) the joint (48) in engagement with the stop means (50) in one operational state and, in another operational state, to move the joint (48) in a sense to reduce the angle.

5. Locking device as set forth in claim 4, characterized in that (a) the stop means (50) is mounted structure-fixed and (b) the displacement member (52) is a solenoid, which is arranged to urge the joint (48) on the stop means (50) or to lift it from the stop means (50).

6. Locking device as set forth in claim 5, characterized in that the solenoid (52) is arranged on the side of the toggle lever mechanism (40) remote from the stop means (50).

7. Locking device as set forth in claim 6, characterized in that (a) the solenoid (52), upon energization, is in an operating position, in which it keeps the toggle lever mechanism (40) in its block position, and (b) the solenoid (52) is movable into its release position by a restoring force, when it is deenergized.

8. Locking device as set forth in claim 4, characterized in that the displacement member (52) engages the joint (48) through a pivotable intermediate member (52) which is pivotable by the displacement member (52) between a first position, in which it keeps the joint (48) in engagement with the stop means (50), and a second position, in which it releases the joint (48).

9. Locking device as set forth in claim 8 characterized in that the intermediate member (62) is a cam.

10. Locking device as set forth in claim 8, characterized in that the pivot axis of the intermediate member (62), in one operational state, extends essentially through the angle bisector of the obtuse angle between the two links (42,46).

11. Locking device as set forth in claim 10, characterized in that the intermediate member (62) is a cam.

* * * * *